United States Patent [19]

Van Doorn et al.

[11] Patent Number: 4,573,403

[45] Date of Patent: Mar. 4, 1986

[54] SWINGING CHARGE DOOR FOR BALER

[75] Inventors: Donald W. Van Doorn; James B. Hawkins; Francis W. Carpenter, III; Robert E. Lange; Tommy W. Webb, all of Columbus, Ga.

[73] Assignee: Lummus Industries, Inc., Columbus, Ga.

[21] Appl. No.: 662,272

[22] Filed: Oct. 18, 1984

[51] Int. Cl.[4] ..... B30B 9/30

[52] U.S. Cl. ..... 100/43; 100/3; 100/98 R; 100/218; 100/215; 100/255

[58] Field of Search ..... 100/3, 215, 232, 233, 100/90, 256, 43, 255, 269 R, 246, 247, 252, 253, 254, 218, 98 R

[56] References Cited

U.S. PATENT DOCUMENTS

| | | | |
|---|---|---|---|
| 716,422 | 12/1902 | Hulscher | 100/246 X |
| 2,207,032 | 7/1940 | Steinhauer | 100/255 |
| 2,955,529 | 10/1960 | Marble | 100/215 |
| 3,583,312 | 6/1971 | Van Doorn | 100/90 |
| 3,584,433 | 6/1971 | Van Doorn | 100/218 X |
| 3,693,541 | 9/1972 | Lombard | 100/215 X |
| 3,985,072 | 10/1976 | Van Doorn | 100/255 |
| 4,136,609 | 1/1979 | Van Doorn | 100/255 X |

FOREIGN PATENT DOCUMENTS

| | | | |
|---|---|---|---|
| 1145926 | 3/1963 | Fed. Rep. of Germany | 100/255 |
| 393164 | 5/1965 | Switzerland | 100/215 |

*Primary Examiner*—Billy J. Wilhite

*Attorney, Agent, or Firm*—Jennings, Carter, Thompson & Veal

[57] ABSTRACT

A charge door assembly for automated operation of a baler utilizes a truncated wedge-shaped door pivotally mounted to the baler at a point beneath the lowest point of travel of a conventional movable platen. The door pivots outwardly to admit a charge of material onto the platen from a feed apparatus. Intermeshing teeth are provided along the door assembly fact to separate any material extending outwardly of the door as the door closes. Sufficient space is provided between the door and the passageway therefor to allow material stringing from the teeth to be attenuated and subsequently entrained by the action of the baler.

23 Claims, 5 Drawing Figures

16
51
52
11
59
46
37
49
43
64
70
55
27
29
39
24
68
23
10
36
109
66
22
18
21
21
86
87
17
119
31
119
96
130
91
98
94
93
92
76
79
83
125
84
73
81
82
78
77
71
68
-B-
74
69
14
72
12
67

Fig 3
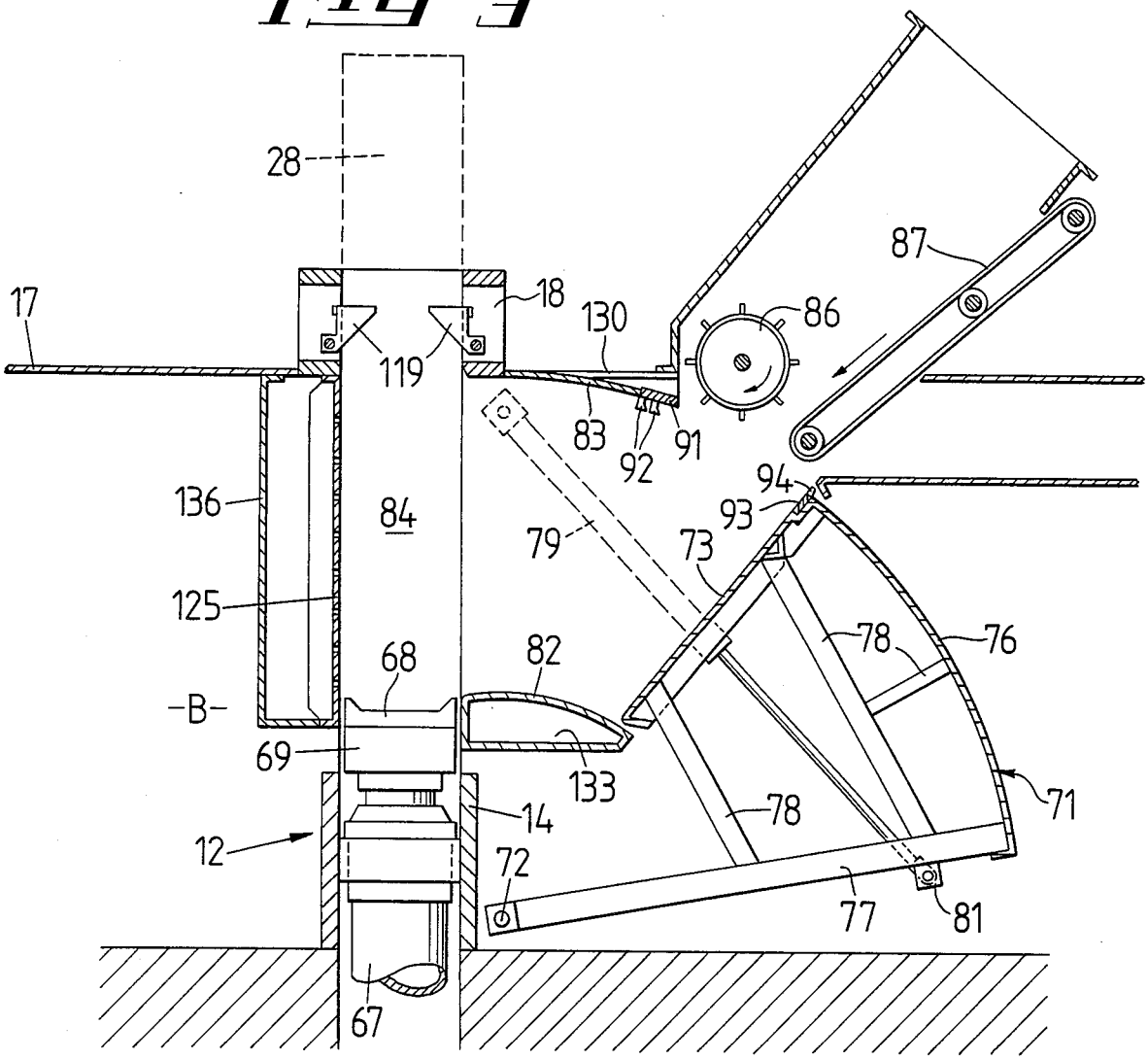
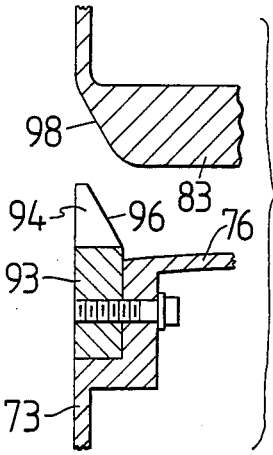
Fig 4
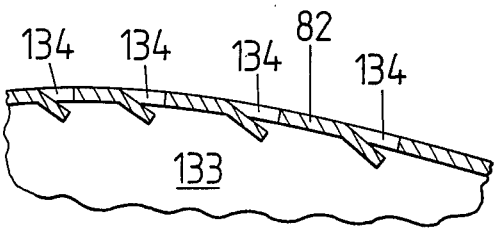
Fig 5

SWINGING CHARGE DOOR FOR BALER

BACKGROUND OF THE INVENTION

The present invention relates to the field of baling materials and more particularly to improvements in apparatus for charging a single box baler. In even greater particularity the present invention may be described as a charging door assembly for introducing material, such as fiber, into a charging box.

The basic construction of a single box baler having a hinged charging door below floor level is well known. Heretofore, such a door was hinged adjacent the lowest portion of the movable platen and formed a pie shaped extension to the charging box when opened. The material was introduced from immediately above the door and adjacent the upper wall of the baler. Normal operation of such apparatus required a manual feed to ensure that the material did not protrude above the charging door and thereby prevent closure of the door. Little effort was made to automate such apparatus due to the fact that problems were encountered with the fibrous mass extending above the door.

It is also important to be able to charge as much fiber as possible into the charging box below floor level. With prior art apparatus fiber would be left in the area between the means for delivering fiber to the baler and the charge door, which must be closed to form the charging box on the baler. This presented a major problem in automation of this type of press inasmuch as this mass of fiber had to be severed, which presented a problem about as difficult as biting through steel.

SUMMARY OF THE INVENTION

It is an object of the present invention to provide an automated swinging charge door assembly for delivering material to a baling charge box.

Another object of the invention is to provide a charge door capable of cleanly separating fiber to be compressed into a charge box without jamming the door.

To accomplish these and other objects of the invention, our improved baler uses a charge door of unique construction. The charge door is hinged a substantial distance below the lowest point of travel of the conventional movable platen. Adjacent this lowest point of travel is a lower intermediate panel which is arcuate in shape and extends outwardly in the same direction as the charge door. This arcuate lower intermediate panel serves to truncate a pie-shaped cavity which is formed upon opening the charge door. The charge door itself is thus a truncated wedge which sweeps across the upper surface of the lower intermediate panel. The charge door has an upper arcuate cover which is supported by a front panel and a rear beam. Mounted directly above the upper arcuate cover of the charge door is an upper intermediate arcuate panel which also extends outwardly from the baler and is cooperatively positioned adjacent the upper arcuate cover of the door. Affixed to the front panel of the door and also to the upper arcuate panel are intermeshing teeth which separate the material to be baled. The door is movable selectively to an open position and to a closed position. A space is defined between the upper arcuate cover of the door and the upper arcuate panel, whereby fibers may string back over the cover.

BRIEF DESCRIPTION OF THE DRAWINGS

The novel features to be patented are set forth in the appended claims; however a fuller understanding of the operation of the present invention as well as appreciation of the objects, features and advantages of the instant invention may be gained from a perusal of the description of the preferred embodiment in conjunction with the attached drawings, in which:

FIG. 3 is a sectional view of the charge door assembly shown in an open position;

FIG. 4 is a detail cross section of the junction of the charging box and the charge door assembly in the closed position; and FIG. 5 is a fragmental sectional view of the bottom intermediate panel showing air passages therein.

DESCRIPTION OF THE PREFERRED EMBODIMENT

Figure 1:
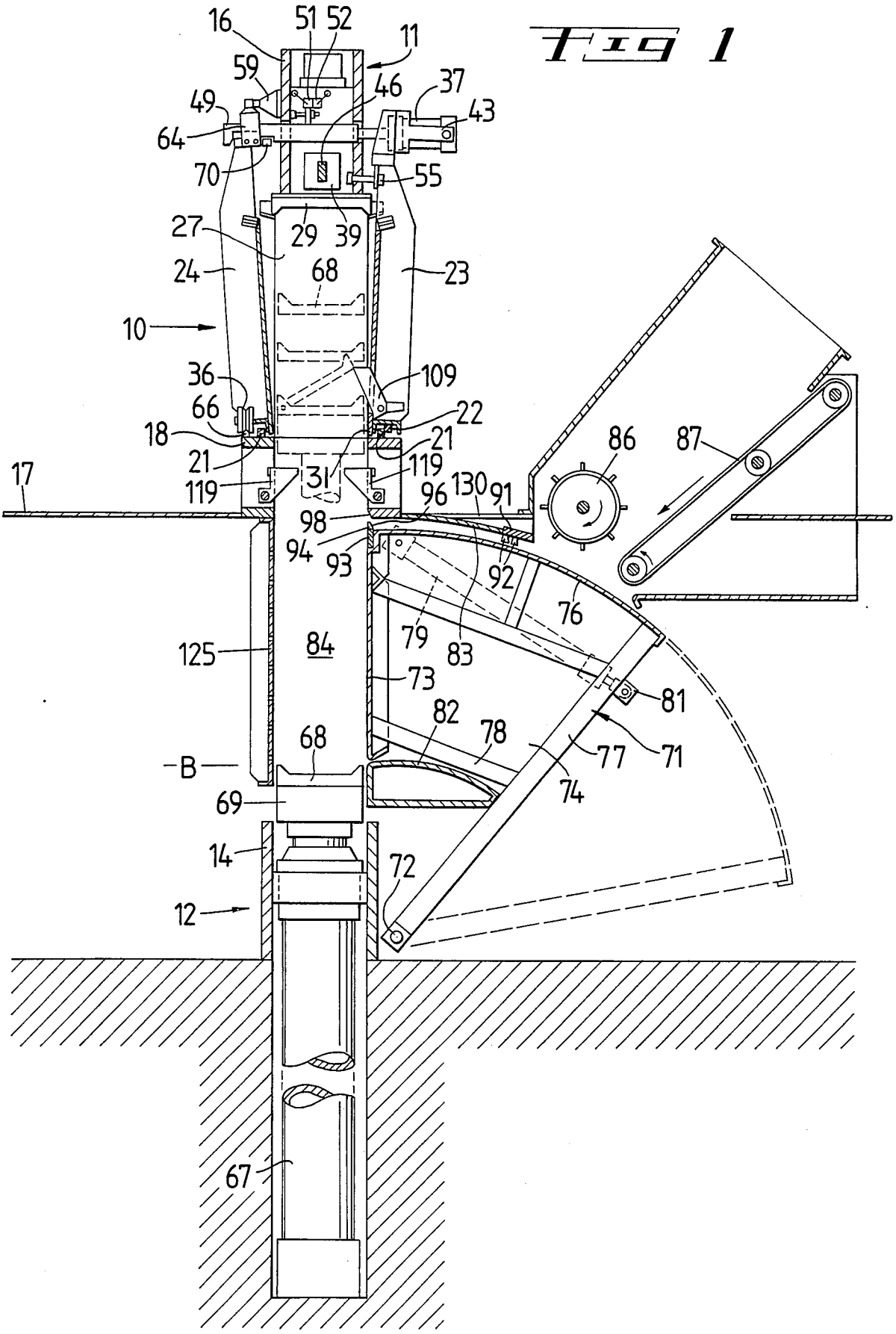
FIG. 1 is a vertical sectional view of the charging door assembly showing a baling chamber mounted above the assembly.

With reference to the Figures, an up-packing baler is shown generally at 10. This baler will be described with reference to two major sections: an upper press section shown generally at 11, and a lower press section shown generally at 12. The lower press section 12 is located beneath the floor plate 17 and is in fact beneath the floor of the working space as is conventional with up-packing balers of this type. Strain rods 13 connect the two major sections from a bottom sill 14 to a top sill 16. It should also be noted that the entire structure is mounted relative to the floor in a rather conventional manner. While the charge door assembly to be described hereinafter may be used with various types of upper press sections, it is shown in conjunction with an upper press section of the type shown in our co-pending application Ser. No. 662,226, filed concurrently herewith, now U.S. Pat. No. 4,550,657. That is, the charge door assembly is not limited to such a combination.

Mounted above the floor plate 17 is a sleeve support 18 which has housed within it a plurality of pivotable dogs 119, as shown in FIG. 3, which are conventional in construction and operation. These dogs 119 hold the previously charged stock above the charging box, indicated generally at 84, during subsequent charging cycles. In the embodiment disclosed herein the stock is fibrous material held within a baling chamber 28.

It is to be understood that the up-packing baler herein described requires a ram 67 and a bottom platen 68 upon which the fibrous material or lint to be compressed is placed and a mounting bar 69 which connects the ram to the platen. Ram 67 and platen 68 reciprocate between the baling chamber 28 and the charging box 84 to compress the lint or fiber delivered to the charging box and then into baling chamber 28. Mounted at a point substantially below the lowest point of travel of the platen 68 is a pivot bearing 72 on which is mounted a swinging charge door 71 having a front panel 73 extending upwardly therefrom to define the rear wall of the charging box 84. Swinging charge door assembly 71 also has a rear structure of beams 77 and gussets 78 which are connected to the front panel 73 and an arcuate cover 76. This rear structure provides suitable reinforcing members within the swinging charge door assembly 71 to mount two hydraulic cylinders 79 by means of pivotal cylinder mounting brackets 81. As shown in FIGS. 1 and 3, there is also provided a bottom intermediate panel 82 and a top intermediate panel 83 which, along with two side panels 74, define a passageway for the swing charge door assembly 71. Both intermediate panels 82 and 83 are arcuate as shown. The top arcuate panel 83 is constructed and arranged to cooperate with the arcuate cover 76 to form a well defined and uniform space therebetween. The bottom intermediate panel 82 is swept by the lower end of front panel 73 as the door swings to open and closed positions. Above the top intermediate panel 83 is a walkway 130 upon which an operator may stand.

Fiber is delivered to the passageway in the open charge door assembly 71 by a fiber feed cylinder 86 in conjunction with a fiber feed belt 87. The fiber feed cylinder 86 is shown as being a finned drum mounted for powered rotation. The fiber feed belt is shown as being a roller mounted belt. The fiber feed cylinder 86 and the fiber feed belt 87 urge the material into the passageway through the charge door assembly 71 whereupon it is then urged into the open charging box 84. The cylinder 86 and the feed belt 87 are reversible.

Mounted on the top intermediate panel 83 is a stationary batt breaker plate 91 which has extending therefrom two rows of staggered teeth 92. Mounted on the front panel 73 of the swinging door assembly 71 is a movable batt breaker bar 93 which carries a single row of teeth 94 which extend outwardly of and above the arcuate cover 76. The upwardly extending teeth 94 are right triangular in shape, as shown in FIG. 4, whereby the back sides 96 thereof slope downwardly. The upper, inner edge of the charging box 84 immediately adjacent the batt breaker bar 93, when the swinging door assembly 71 is in the closed position, has the forwardly extremity thereof beveled downwardly and rearwardly to form a surface 98 which is cooperatively aligned with the back sides 96 of the teeth 94.

In operation, it is important to charge as much fiber as possible during each charge cycle. Thus the longer moment arm of charge door assembly 71 which pivots about pivot bearing 72 provides for a greater volume within the open charge door assembly 71, even though a truncated wedge-like space is defined by the motion of the charge door assembly 71. Front panel 73 pivots rearwardly to an angular inclination of approximately 50° from the horizontal, which is slightly greater than the angle of least repose for most fibrous material. In order to hasten the operation of the charging assembly a tramp stroke limit switch 57 is provided to interact with a control rod 56 depending from platen 68 to indicate that the ram 67 has reached its maximum upward displacement and also to indicate when the ram starts downward movement from this displacement. The entire sequence of operation of the instant invention is coordinated by a conventional control processor, not shown, which receives an input from the limit switch 57 indicating the starting of downward movement of the ram 67. As the ram 67 starts its downward stroke, charging door assembly 71 is opened so that by the time the ram 67 and platen 68 are in the full down position, indicated at B in FIGS. 1 and 3, the door assembly 71 is open and the fiber or other material has begun to fall past fiber feed cylinder 86 and belt feeder 87. The fiber that falls during the descent of the ram 67 falls onto bottom intermediate panel 82 rather that into the well of the ram 67 as would have been the case in the prior art. Fiber is thus charged through the open door assembly 71 into the charging box 84 by the cylinder 86 and feed belt 87. As these components urge the material into the open charging box 84 they momentarily compress the material, thus removing a portion of the air contained in the material. This is especially helpful in baling fibrous material in that substantially more material may be packed into the open charging box 84 with this removal of air. It has also been found that better results are accomplished by providing the front wall 125 of the charging box 84 with perforations, as shown in FIGS. 1 and 3, to remove air during compression of the material by closure of the charge door assembly 71.

It may also be desirable to provide a plenum chamber 133 beneath the bottom intermediate panel 82 and a plurality of air passages 134 through this panel to selectively force air therethrough toward the front wall 125. This tends to move the material deposited on and above the panel 82 toward the charging box 84. The introduction of this air would be coordinated with the lowering of the ram. Also, a negative pressure plenum chamber 136 may be provided outwardly of the front wall 125 to further enhance the packing capabilities of the charge door assembly 71. It should be noted that in achieving the maximum charge to the charging box 84 via the above described charging mechanisms a substantial amount of fiber remains in the area defined between the charging cylinder 86, fiber feed belt 87 and the front panel 73 of swinging charge door assembly 71. The fiber to be compressed into charging box 84 must be severed from the fiber remaining in the above charging mechanism. However, such compressed fiber, as necessary in the operation of the baler, has been described as being substantially as strong as steel. To overcome this extremely dense mass of material, fiber feed cylinder 86 and fiber feed belt 87 are momentarily reversed to pull back some of the fiber that has been compacted into the chamber below, thus lowering the density of the fiber in the area forwardly of the front panel 73 of swinging charge door assembly 71. The fiber must be severed without jamming of the swinging charge door assembly 71 as it closes. Furthermore, the material must be separated whereby appreciable amounts do not string below the bottom platen 68 as it urges the material upwardly. To accomplish this there is an appreciable uniform clearance between the top arcuate cover 76 of the charging door and the top intermediate panel 83 which is also arcuate and which is positioned above the charging door. A one inch clearance is deemed to be sufficient between these surfaces; however, in practice a two inch clearance is actually provided. This clearance allows any streamers of material extending over the top of the charge door assembly to thin out rather than to bunch up.

The clearance also accommodates teeth 94 which project above the arcuate cover 76 of the swinging charge door assembly 71. These teeth pass between the stationary breaker bar teeth 92 of batt breaker plate 91 which is mounted on the intermediate panel 83 adjacent the rearmost projection thereof. It should be noted that the stationary teeth 92 have been staggered so that the shear forces may act on the compressed lint in two steps rather than one which is a significant advantage when congestion occurs in this area. It has been found that a two inch lateral clearance between the adjacent teeth on the individual breaker bars provides a $\frac{3}{4}$ inch clearance between the stationary and moving teeth which are each $\frac{1}{2}$ inch wide. With these exemplary dimensions the moving breaker bar teeth 94 intermesh with the stationary breaker bar teeth 92 approximately one inch and the moving teeth 94 pass approximately ½ inch from the stationary arcuate top intermediate panel 83. Since these teeth 94 are uniformly positioned to move at a uniform distance from the arcuate surface of intermediate panel 83, fiber, which becomes evermore dense as the door closes, does not tend to extrude over the top of any particular teeth on the charging door. As mentioned above, the back sides 96 of the breaker bar teeth 94 are cooperatively formed such that when the swinging charge door assembly 71 is in closed position there is a gap between the breaker bar teeth 94 and the beveled surface 98 which is greater than the separation between teeth 94 and intermediate panel 83 as the moving teeth 94 pass beneath the intermediate panel 83. Accordingly, any fiber compacted above the teeth 94 is at least partially released when the assembly 71 is fully closed. Therefore as the ram 67 and bottom platen 68 move up within the charging box 84 toward the baling chamber 28 any fibrous material which is stringing out over the arcuate cover 76 is pulled from within this interstice without encountering substantial resistance; consequently such fibers are entrained within the main mass of fibers moving upwardly. By the time the ram and platen 68 pass this critical area all the fibers will remain on the top of platen 68 with no appreciable extrusion of fibers around the edge of the platen.

Although many types of upper presses may be used with our novel charging door assembly, an upper press assembly of particular utility in the fiber baling field will now be described for use in combination with the hereinabove described charging door assembly.

Above the floor plate 17 is a sleeve support 18. The upper surface of the sleeve support 18 has projections 21 which are utilized in mounting the rigid baling chamber doors. Mounted thereabove are a rear side door 23 and a front side door 24 and two end doors 26 and 27, which in conjunction with top platen 29, form a baling chamber 28.

The front and rear side doors are of a novel construction. Each door comprises a plurality of vertical plates 19 evenly spaced across the door. Each vertical plate 19 is supported by a strength member 19' which also is vertically oriented and which is mounted to upper and lower horizontal beams 20. Between each pair of vertical plates 19 is a slot 25 which cooperates with the slotted top platen 29 and the slotted bottom platen 68 to facilitate tying the bale as will be explained hereinafter.

The lower portion of each of the doors 23–24 and 26–27 have extending downwardly therefrom a weight bearing flange 31. Each flange 31 rests on the upper surface of sleeve support 18 inwardly of the projections 21. Each flange 31 thus abuts the adjacent projection 21, thereby restraining outward movement of the lower portion of each door.

Figure 2:
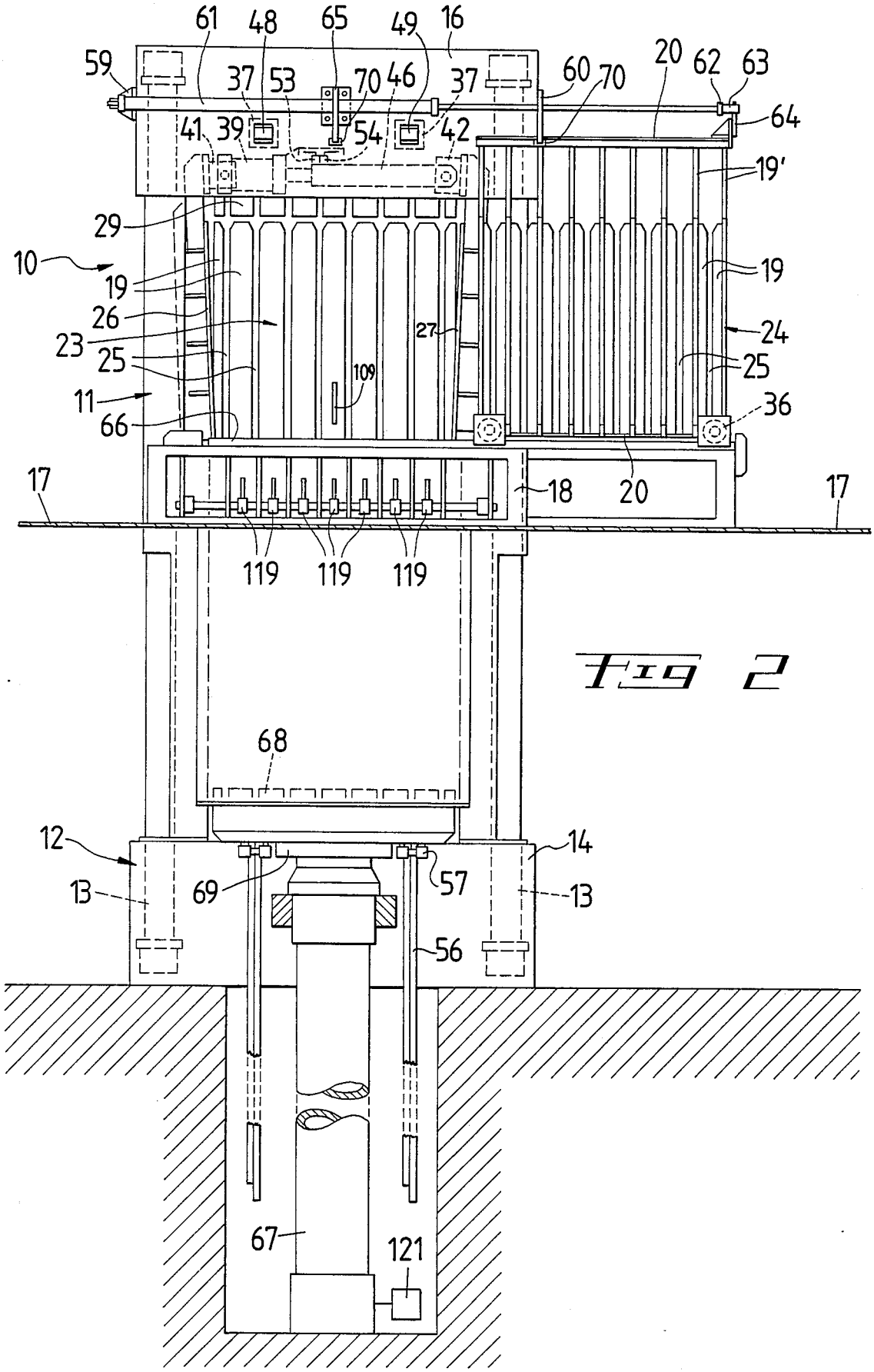
FIG. 2 is a front elevational view, partly in section, showing the ram and limit switch associated therewith.

The upper portions of the doors, however, may be pivoted outwardly. Also mounted to the lower portion of each door 23–24 and 26–27 is a retaining bar 22 which cooperates with the flange 31 on its door to form a channel for receiving the projection 21, which is thereby located intermediate the flange 31 and the retaining bar 22. The retaining bar 22 abuts the outer surface of the projection 21 to prevent the flange 31 from moving inwardly as each door pivots on its respective flange. This pivotal motion of the upper portion of the doors is induced by two side door hydraulic cylinders 37 and an end door hydraulic cylinder 39. The end door hydraulic cylinder 39 is mounted between the two end doors 26 and 27 on cylinder mounting blocks 41 and 42 by a bar connector 46 such that the end door hydraulic cylinder 39 can force the upper portion of the doors apart or urge the doors into their closed upright position as required. Likewise, side door hydraulic cylinders 37 are mounted between front side door 24 and rear side door 23 by the use of extended cylinder mounting brackets 43 and locking bars 48 and 49, as shown in FIG. 2. Thus it can be seen that through the operation of the hydraulic cylinders the end doors act in opposition to one another, as do the side doors. Side door hydraulic cylinders 37 act in unison and may be replaced by a single cylinder with appropriate mounting hardware to equalize the lateral loading effect across the doors. Each of the cylinders 37 and 39 is matched to its paired end or side doors such that the same area to compression ratio is maintained over the area of the door. Limit switches 51–54 mounted intermediate the paired doors are used to insure that each door moves the proper distance away from its adjacent bale side. This is a result obtained by using common hydraulic cylinders on opposing doors and positioning the limit switches to allow each door to move the proper distance. The end door limit switches 53–54 are actuated at the proper spacing by their position relative to cylinder 39 and the side door limit switches 51–52 are actuated at the proper spacing by their position relative to the top sill 16.

It will be noted that the front side door 24 has mounted thereon rollers 36 which are situated above a track 66 which extends alongside and parallel to the front side door 24 and laterally beyond this front side door. A rear side door stop 55 limits pivotal motion of the top portion of the rear side door 23 at a predetermined location. Hydraulic cylinders 37 can then urge the top portion of the front side door 24 outwardly further thereby engaging rollers 36 with the track 66 and lifting flange 31 out of engagement with sleeve support 18. Mounted on the top sill 16 is a cylinder mounting bracket 59 to which is pivotally attached a door opening hydraulic cylinder 61 which extends above and parallel to the front side door 24. Attached to the piston rod of the cylinder 61 is a self-aligning rod coupler 62 and a knuckle 63 as well as a pivot bracket 64 which is connected to the end of front side door 24. Mounted along the top sill 16 in conjunction with the hydraulic cylinder 61 and the front side door 24 are an end cam roll bracket 60 and a center cam roll bracket 65 and the associated cam followers 70 which cooperate with other cam followers 70 on locking bars 48 and 49 to align the front side door 24 when hydraulic cylinder 61 is utilized to roll the front side door 25 to and fro to open and close the baling chamber 28. An ejection dog 109 is provided to automatically eject a tied bale from baling chamber 28 when front side door 24 is in the open position. This dog 109 utilizes the same principle as disclosed in U.S. Pat No. 3,584,433, owned by the common assignee herewith and incorporated herein by reference.

Ram 67 and platen 68 reciprocate between the baling chamber 28 and charging box 84 whereby lint or fiber delivered to the charging box is introduced into the baling chamber 28. Depending from the platen 68 is the control arm 56 which actuates a plurality of limit switches which are mounted in a conventional manner near the point of lowest travel of the platen. Such control arms and limit switches are well known and will not be further described except to say that such units are used to control the stroke of the ram 67 at the various stages of the baling process. For example, the tramp strokes are shorter than the final compression stroke which may be variable depending on the size and weight of the bale. All of these limit switches are connected to a processor such as the Modicon M-84, which controls the operation of the baler. Of particular importance is the tramp stroke limit switch 57 which normally indicates to the processor that the ram has reached its desired charging stroke, thus the processor logic reverses the ram motion to cause the same to descend and receive an additional charge of lint. However, a sensor 121 is also used to indicate the pressure exerted by the hydraulic ram in reaching the charging stroke. This sensor 121 may measure the amperage drawn by a motor, not shown, which drives a hydraulic pump, also not shown, for the ram 67. The hydraulic pressure may also be sensed directly. Either method provides a measure of the bale weight as is well known and may be adjusted within a range to achieve a bale weight of approximately 500 pounds.

While we have shown our invention in but one form, it will be obvious to those skilled in the art that it is not so limited but is susceptible of various changes and modifications without departing from the spirit thereof.

What we claim is:

1. In a baler having a supporting frame and a charging box for accumulating fibrous material to be compressed into a bale by a ram mounted platen:

(a) a charge door mounted on said supporting frame to provide a closure for said charging box in a first position and to expose said charging box in a second position;

(b) means for introducing fibrous material into said charging box cooperatively positioned adjacent said charge door; and (c) means for separating said fibrous material intermediate said charge door and said introducing means as said charge door moves from said second position to said first position wherein said separating means includes a row of spaced teeth extending outwardly and upwardly of said charge door and a plurality of spaced staggered teeth on said supporting frame in spaced relation to said charging box to mesh with said teeth on said charge door when said charge door moves between said second and first positions, with said charging door and said supporting frame having a minimum, uniform, predetermined clearance therebetween.

2. In a baler as in claim 1 wherein said teeth of said charge door extend into said clearance such that said teeth pass proximal said introducing means and said supporting frame at a uniform distance therefrom.

3. In a baler as in claim 1 wherein said charge door has a planar inner face and said teeth on said charge door have one side thereof aligned with said planar inner face and also have an inclined rear surface such that said teeth have a substantially right triangular profile and wherein said charging box has a beveled surface aligned with and in spaced relation to said rear surfaces of said teeth when said charge door is closed whereby fibers extending between said teeth are readily entrained within the bale as said platen compresses said bale.

4. In a baler having a supporting frame and a charging box for accumulating fibrous material to be compressed into a bale by a ram mounted platen, a charge door mounted on said supporting frame and moveable selectively to an open position and a closed position and an introducing means for introducing fiber into said charging box cooperatively positioned adjacent said charge door, the improvement comprising:

(a) a row of spaced teeth affixed to said charge door and extending therefrom towards said introducing means; and (b) a plurality of spaced teeth affixed to said supporting frame intermediate said charging box and said introducing means and positioned to cooperatively mesh with said row of spaced teeth as said charge door moves from said open position to said closed position with there being a predetermined uniform clearance between said charge door and said introducing means whereby the mass of said fibers intermediate said charge door and said introducing means is severed in a substantially uniform manner.

5. The improvement as defined in claim 4 wherein each of said teeth in said row of spaced teeth is aligned with the plane of said charge door on the side thereof adjacent said charging box with each of said teeth having an inclined rear surface such that each of said teeth have a substantially right triangular profile and wherein said charging box has a beveled surface aligned with and in spaced relation to said row of spaced teeth when said charge door is in said closed position whereby fibers extending between said teeth are readily entrained with the mass of fibers as said platen compresses said bale.

6. In a baler having a supporting frame and a charging box for accumulating fibrous material to be compressed into a bale by a ram mounted platen:

(a) a charge door including (i) a planar front panel;

(ii) an arcuate cover panel connected to said front panel;

(iii) reinforcing members cooperatively connected to said arcuate cover panel and said front panel;

(iv) means extending beneath said reinforcing members to said supporting frame for pivotally mounting said door thereto at a point substantially below the lowest point of travel of said platen to provide a closure for said charging box in a first position and to expose said charging box in a second position;

(v) power means for opening and closing said door; and (b) means for introducing fibrous material into said charging box cooperatively positioned adjacent said charge door;

(c) an upper arcuate member cooperatively positioned above said arcuate cover panel intermediate said charging box and said means for introducing fibrous material with said arcuate cover panel and said upper arcuate member having a minimum, uniform, predetermined clearance therebetween; and (d) means for separating said fibrous material intermediate said charge door and said means for introducing fibrous material as said charge door moves from said second position to said first position, said means for separating including a batt breaker bar mounted on said front panel of said charge door at the junction of said front panel and said arcuate cover panel, said batt breaker bar having a row of spaced teeth extending outwardly and upwardly of said arcuate cover panel, and a batt breaker plate mounted on said upper arcuate member proximal said means for introducing fibrous material, said batt breaker plate having a plurality of spaced staggered teeth positioned thereon to mesh with said teeth of said batt breaker bar when said charge door moves between said second and first positions.

7. In a baler as in claim 6 wherein said teeth of said batt breaker bar extend into said clearance between said arcuate cover panel and said arcuate member such that said teeth pass proximal the adjacent surface of said arcuate member at a uniform distance therefrom.

8. In a baler as in claim 6 wherein said teeth on said batt breaker bar have an inclined rear surface such that said teeth have a substantially right triangular profile.

9. In a baler as in claim 8 wherein said baler has an internal wall defining a juncture with said upper arcuate member with said juncture being beveled to increase the clearance above said teeth of said batt breaker bar when said charge door is in said first position.

10. In a baler as in claim 6 wherein said fiber introducing means is reversible.

11. In a baler having a supporting frame and a charging box for accumulating fibrous material to be compressed into a bale by a ram mounted platen;

(a) a charge door including (i) a planar front panel;

(ii) an arcuate cover panel connected to said front panel;

(iii) reinforcing members cooperatively connected to said arcuate cover panel and said front panel;

(iv) means extending beneath said reinforcing members to said supporting frame for pivotally mounting said door thereto at a point substantially below the lowest point of travel of said platen to provide a closure for said charging box in a first position and to expose said charging box in a second position;

(v) power means for opening and closing said door; and (vi) a lower arcuate member extending from said supporting frame proximal the lowest point of travel of said platen and swept by said planar front panel such that the volume defined as said charge door moves between said first and second positions is in the shape of a truncated wedge;

(b) means for introducing fibrous material into said charging box cooperatively positioned adjacent said charge door; and (c) means for separating said fibrous material intermediate said charge door and said means for introducing fibrous material as said charge door moves from said second position to said first position with said separating means being in part secured to said door at the juncture of said front panel and said arcuate cover panel.

12. In a baler as in claim 11 wherein said lower arcuate member is perforated such that air may be forced therethrough toward said charging box.

13. In a baler having a supporting frame and a charging box for accumulating fibrous material to be compressed into a bale by a ram mounted platen;

(a) a charge door pivotally mounted on said supporting frame at a point substantially below the lowest point of travel of said platen to provide a closure for said charging box in a first position and to expose said charging box in a second position;

(b) means for introducing fibrous material into said charging box cooperatively positioned adjacent said charge door; and (c) means for separating said fibrous material intermediate said charge door and said introducing means as said charge door moves from said second position to said first position including:

(i) a row of spaced apart teeth carried by said charge door and projecting upwardly of said charge door; and (ii) a plurality of spaced apart teeth mounted on said supporting frame proximal said means for introducing fibrous material, and in intermeshed relation with said teeth projecting from said charge door.

14. In a baler having a supporting frame and a charging box for accumulating fibrous material to be compressed into a bale by a ram mounted platen:

(a) a charge door pivotally mounted on said supporting frame at a point substantially below the lowest point of travel of said platen to provide a closure for said charging box in a first position and to expose said charging box in a second position;

(b) means for introducing fibrous material into said charging box cooperatively positioned adjacent said charge door;

(c) means for separating said fibrous material intermediate said charge door and said introducing means as said charge door moves from said second position to said first position;

(d) a baling chamber adapted to receive a movable platen and in part defined by four rigid upright doors with each of said doors being pivotally supported along its lower edge by said supporting frame so that its upper portion is movhble inwardly and outwardly relative to said chamber;

(e) means responsive to the compressive force exerted on said fibers by said movable platen for decreasing the lateral pressure exerted on said fibers by said doors; and (f) means for displacing one of said doors for removing said bale from said baling chamber.

15. In a baler as in claim 14 wherein said means for decreasing lateral pressure exerted on said fibers comprises:

(a) means for sensing the compression exerted on said fibers by said movable platen;

(b) means for hydraulically positioning the upper portions of said upright doors responsive to the compression sensed by said sensing means; and (c) means utilizing said sensing means for controlling said positioning means.

16. In a baler as in claim 15 further comprising upstanding projections carried by said supporting frame outwardly of and adjacent said upright doors, said upright doors comprising a pair of end doors, a rear side door, and a front side door with each of said doors having a flange extending from the lower portion thereof, said flanges engaging said projections and supporting the weight of said doors, and said projections and flanges providing pivotal mountings for said doors.

17. In a baler as in claim 16 wherein said positioning means comprises:

(a) double-acting hydraulic cylinders operatively connected between said front and rear side doors, said hydraulic cylinders being operatively connected to said doors at the upper portion thereof such that said upper portions of said doors may be held in their normal upright position or urged outwardly a predetermined distance; and (b) a door stop for arresting the outward motion of the upper portion of said rear side door at a predetermined position.

18. In a baler as in claim 17 further comprising means for selectively positioning the upper portion of said end doors to a vertical position and a position offset from vertical.

19. In a baler as in claim 17 wherein said front side door has rollers mounted thereon with said rollers supporting the weight of said door from said flange when said upper portion of said front side door is urged outwardly a second predetermined distance, said front door being slidably attached to said hydraulic cylinders such that said door can be moved away from said baling chamber on said rollers.

20. In a baler as in claim 16 wherein said front side door is movable along a horizontal track engaged by said rollers when said rollers bear the weight of said door, and means operatively connected to said front side door for urging said front side door along said track selectively to an open position and a closed position.

21. In a baler as in claim 16 wherein said rear side door and said front side door each comprise:

(a) a plurality of vertical members horizontally spaced apart;

(b) a plurality of vertical strength members each reinforcing one of said vertical members; and (c) horizontal connecting and strengthening beams connected to said vertical members and said vertical strength members across the top and bottoms of said doors.

22. In a baler as in claim 14 wherein said upright doors have vertical slots therein for receiving bale ties whereby said bale may be tied while within said baling chamber.

23. In a baler as in claim 14 in which an ejection dog is positioned within said baling chamber in position to cooperatively engage said moving platen, after said bale has been compressed to eject said bale from said baling chamber.

* * * * *